US006585522B1

(12) United States Patent
Simmons

(10) Patent No.: US 6,585,522 B1
(45) Date of Patent: Jul. 1, 2003

(54) FABRIC SELECTION SYSTEM

(76) Inventor: Annamarie Simmons, 4802 Telegraph Ave., Oakland, CA (US) 94609

( * ) Notice: Subject to any disclaimer, the term of this patent is extended or adjusted under 35 U.S.C. 154(b) by 0 days.

(21) Appl. No.: 09/724,048

(22) Filed: Nov. 28, 2000

(51) Int. Cl.[7] ..... G09B 25/00
(52) U.S. Cl. ..... 434/395; 434/99
(58) Field of Search ..... 434/395, 367, 434/99; 219/56, 225, 78.15, 50, 51

(56) References Cited

U.S. PATENT DOCUMENTS

| | | | | | |
|---|---|---|---|---|---|
| 886,057 | A | | 4/1908 | Hockaday | |
| 1,811,766 | A | * | 6/1931 | Steadman et al. | |
| 1,848,943 | A | * | 3/1932 | Foley | |
| 2,297,282 | A | * | 9/1942 | Belden | 35/56 |
| 2,329,867 | A | * | 9/1943 | Whitehead | 154/1 |
| 3,430,364 | A | | 3/1969 | Kirschbaum | 35/49 |
| 3,567,896 | A | * | 3/1971 | Chang | 219/50 |
| 3,680,227 | A | | 8/1972 | Pavelle | 35/27 |
| 4,681,546 | A | | 7/1987 | Hart | 434/99 |
| 4,979,324 | A | * | 12/1990 | Rehtmeyer et al. | 40/490 |
| 5,252,071 | A | | 10/1993 | Hansard | 434/75 |
| 5,358,407 | A | | 10/1994 | Lainer | 434/94 |
| 5,368,485 | A | | 11/1994 | Phillips | 434/75 |

* cited by examiner

*Primary Examiner*—Derris H. Banks
*Assistant Examiner*—Kurt Fernstrom
(74) *Attorney, Agent, or Firm*—Goldstein & Lavas, P.C.

(57) ABSTRACT

A fabric selection system, for allowing a user to visualize an item as if it were fabricated using any of numerous selected fabric samples, comprising a carrier. A graphic representation of the item is imprinted on the carrier, having object lines which include an outline and object lines which depict interior details of the item. The object lines are silver metallic in color and may be heat transferred using metal foil and a die in the shape of the object lines. The outline defines a window which is transparent so that when the carrier is held over one of the selected fabric samples, the selected fabric sample may be viewed through the window so that the item can be visualized in conjunction with that fabric sample. The carrier has a background area outside of the outline which is less than transparent so as to at least partially obscure the selected fabric sample so that the user can focus upon the selected fabric sample in conjunction with the item.

11 Claims, 6 Drawing Sheets

FABRIC SELECTION SYSTEM

CROSS REFERENCES AND RELATED SUBJECT MATTER

This application relates to subject matter contained in utility patent application Ser. No. 09/556,492, filed in the United States Patent Office on Apr. 21, 2000.

BACKGROUND OF THE INVENTION

The invention relates to a fabric selection system, more particularly, the invention relates to a system which allows a user to quickly and easily visualize an item as if it were constructed using a particular fabric, to allow the user to effectively choose between fabrics prior to fabrication of the item.

In both furniture and clothing design, the physical design of the item is only the beginning. Once the shape or configuration is determined, the fabric must be selected. Considering both natural and synthetic fabrics available, plain as well as printed, textured as well as smooth, thousands of fabric choices are available. The same article of clothing can look infinitely different when simply the fabric is switched. Similarly, home furnishings can be take on a completely different look alone and within its environment by changing the fabric.

In order to select fabric for an article, the best visualization of that fabric by a retailer, wholesaler, manufacturer, or consumer can be achieved when one has an actual sample or model of the article made using that fabric. However, making numerous models or samples of the same article requires considerable labor and material expense. In addition, with many articles such as furniture, having numerous examples of the same article of furniture can require considerable storage space.

Typically then, when selecting the fabric for clothing or home furnishing, the designer or the consumer relies on "swatches". A swatch is a relatively small sample of the fabric which is large enough to allow the color, texture, and pattern of the fabric to be seen. Unfortunately, this "swatch-based" system of fabric selection does not allow the consumer or designer to fully visualize the fabric in use with the intended item.

Accordingly, many consumers are not willing to purchase an item using a swatch, because they know that they might be disappointed when they actually see the item in the chosen fabric after the item has already been manufactured. In addition, many designers "shy away" from more exotic fabrics, because they fear wasting expensive material when they can't fully visualize the finished product.

Others have proposed devices which seek to display and allow experimentation with different combinations of colors and patterns. While these units may be suitable for the particular purpose employed, or for general use, they would not be as suitable for the purposes of the present invention as disclosed hereafter.

SUMMARY OF THE INVENTION

It is an object of the invention to produce a fabric selection system which allows a user to visualize an item with a selected fabric as if the item were already manufactured using that fabric. Accordingly, the system superimposes the selected fabric within an image of the item such that the user can easily visualize the item in conjunction with the selected fabric.

It is a further object of the invention to provide a fabric selection system which allows the fabric to be visualized in conjunction with the item alone. Accordingly, the outline of the item defines a window through which the fabric may be fully visualized. Outside that window, the fabric may be partially or fully obscured.

It is another object of the invention to provide a fabric selection system wherein intersecting three-dimensional planes, contours, and interior details of the item are defined. Accordingly, various features of the item are depicted within the window with object lines. "It is another object of the invention to provide a fabric selection system which does not influence the selection of fabric colors. Accordingly, the object lines are silver metallic in color. The silver metallic colored object lines allows the planes of the item to be delineated, without influencing the appearance of the underlying fabric—even in the case of dark fabrics. By a preferred embodiment, the silver metallic colored object lines are made of metallic foil which is heat-pressed using a die in the shape of the object lines of the item."

The invention is a fabric selection system, for allowing a user to visualize an item as if it were fabricated using any of numerous selected fabric samples, comprising a carrier. A graphic representation of the item is imprinted on the carrier, having object lines which include an outline and object lines which depict interior details of the item. The object lines are silver metallic in color and may be heat transferred using metal foil and a die in the shape of the object lines. The outline defines a window which is transparent so that when the carrier is held over one of the selected fabric samples, the selected fabric sample may be viewed through the window so that the item can be visualized in conjunction with that fabric sample. The carrier has a background area outside of the outline which is less than transparent so as to at least partially obscure the selected fabric sample so that the user can focus upon the selected fabric sample in conjunction with the item.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
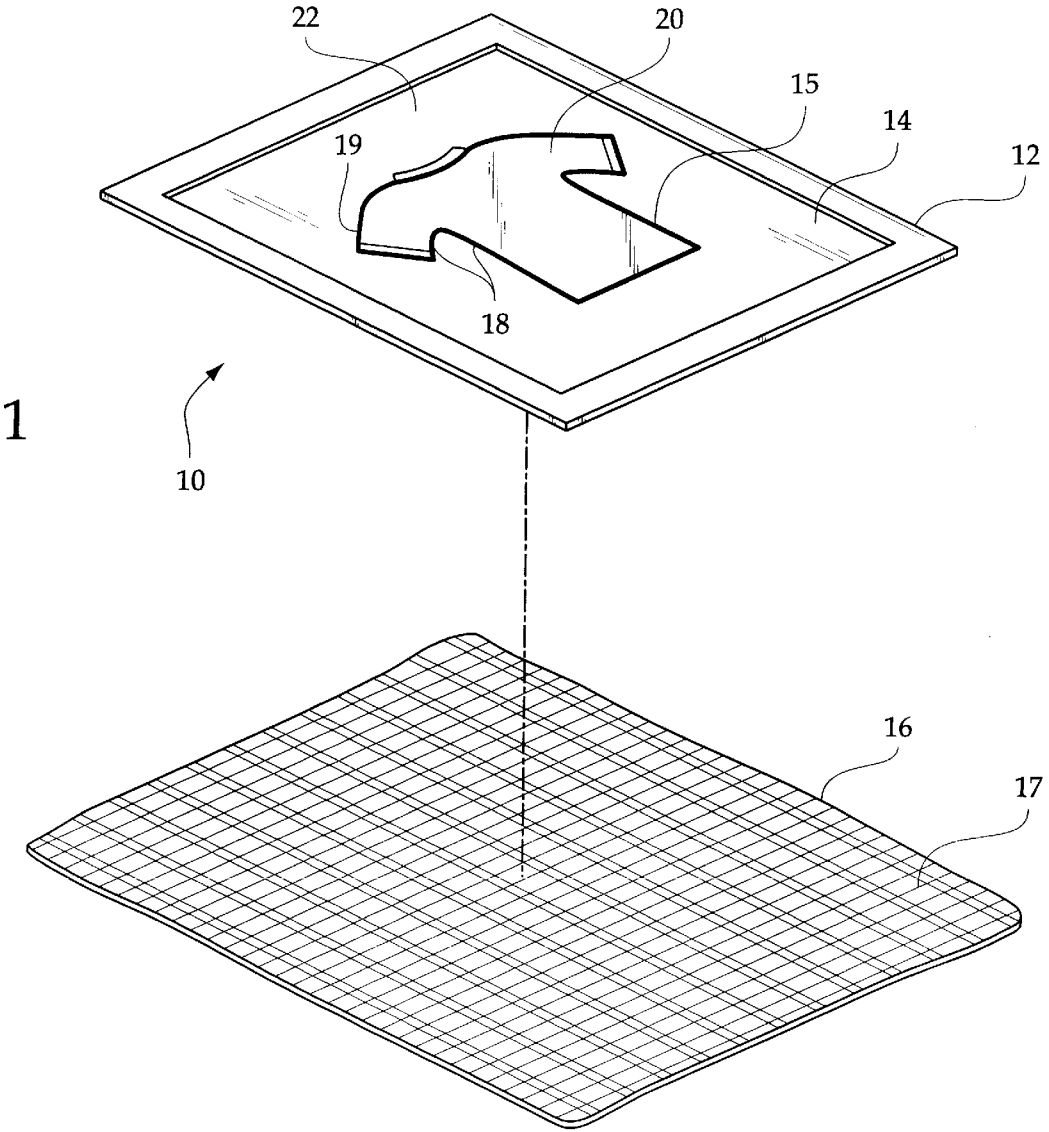
FIG. 1 is a diagrammatic perspective view, illustrating an embodiment of the invention in use, wherein the item is an article of clothing such as a shirt, wherein the invention is being applied over a sample of selected fabric.

FIG. 1 illustrates a fabric selection system which employs a fabric selection device 10, comprising a frame 12 and a carrier 14, wherein the carrier 14 is supported by the frame 12. An item 15 is depicted on the carrier 14. The item 15 is a graphic illustration of the article for which a user wishes to select fabric. The item 15 may be an article of clothing, may be a home furnishing item, or may be any other item for which a fabric must be selected.

Illustrated in FIG. 1, the item 15 is a shirt. The item 15 is illustrated using object lines 18, which generally include object lines which define an outline 19 of the item 15. The object lines 18 define a window 20 therewithin. According to the present invention, the window 20 is transparent. The object lines 18 also define a background area 22. The background area 22 are those portions of the carrier 14 which are outside of the object lines 18, or more specifically outside of the outline 19. According to the present invention, the background area 22 is less than transparent. This lesser degree of transparency present at the background area 22 will be described in greater detail hereinafter.

The device 10 is shown suspended over a selected fabric 16, which is a sample of fabric which a user of the device 10 wishes to visualize in conjunction with the item 15. The fabric 16 shown in FIG. 1 has a repetitive pattern 17.

Figure 2:
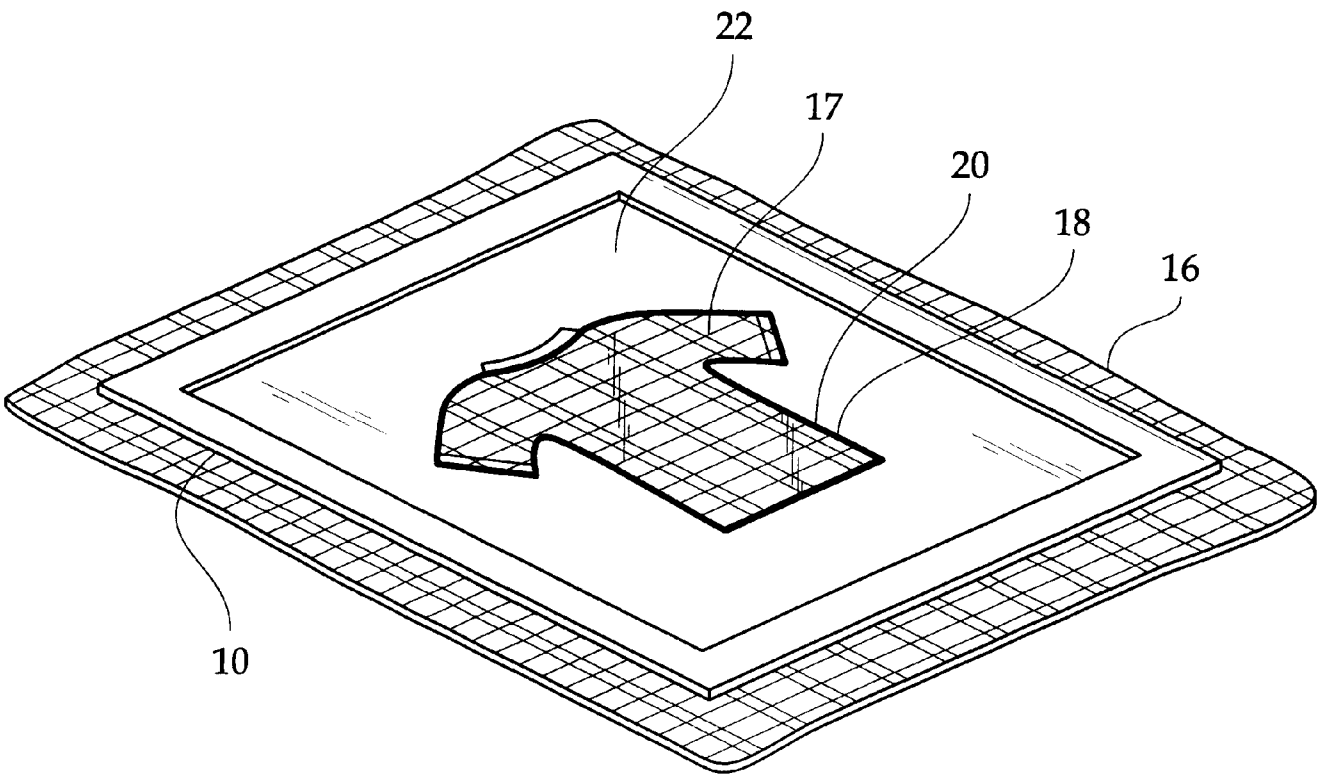
FIG. 2 is a diagrammatic perspective view, wherein the invention has been applied over the sample of selected fabric, such that the selected fabric is seen through the window created within the object lines of the item.

"In FIG. 2, the device 10 has been overlaid directly upon the selected fabric 16. The device 10 does not have any support structure which extends behind the fabric for supporting the selected fabric from behind. The device 10 is simply placed on top of the fabric sample 16. As illustrated in FIG. 2, as well as FIG. 4 and FIG. 6, the fabric sample 16 need not be any particular size, and can be larger than the carrier 14 or device 10. Accordingly, the selected fabric 16 is clearly seen through the window 20 created by the object lines 18. Its repetitive pattern 17 is plainly visible therethrough, along with any color or texture detail, in accordance with features of the selected fabric 16. However, the selected fabric 16 is not viewable through the background area 22, which is fully opaque in the embodiment shown. Thus, the user can easily visualize the item, which is a shirt in FIG. 1, as if it were fabricated using the selected fabric 16.

Figure 3:
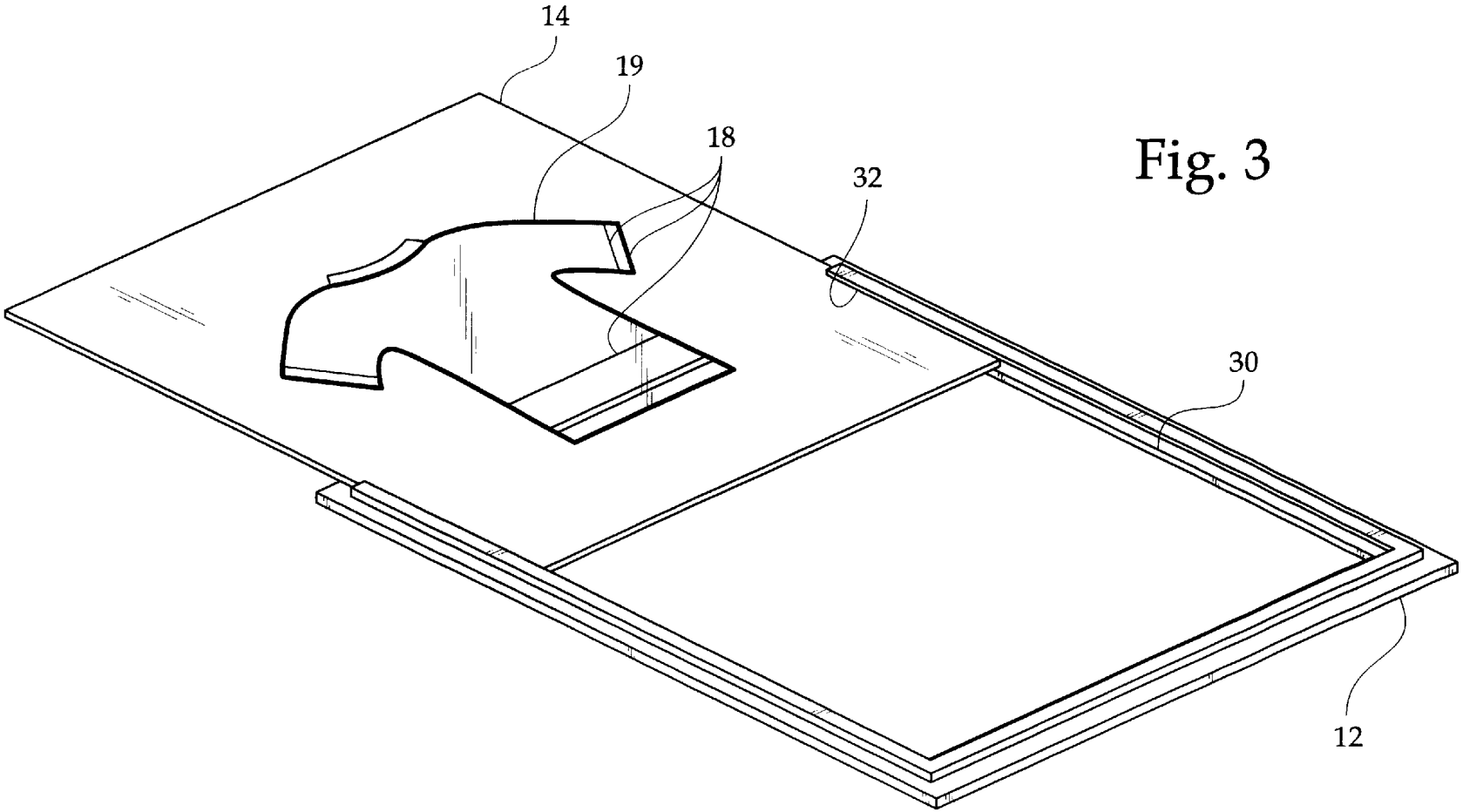
FIG. 3 is a diagrammatic perspective view, illustrating the invention as comprising a frame and a carrier. The carrier is being inserted into the carrier retainer of the frame.

FIG. 3 details construction of the device, wherein the frame 12 comprises an opening 30 and a carrier retainer 32. The carrier retainer 32 may be a guide track which allows the carrier 14 to be slid thereinto, or may be any other means which allows the carrier 14 to be inserted into the frame 12, held securely therein, and removed therefrom when desired.

Also seen in FIG. 3, the object lines 18 can define more than just an outline 19 of the item, it can define interior features of the item as well. The object lines 18, in the case of a garment, can define such interior features within the garment, such as folds, buttons, pockets, and the like.

Figure 4:
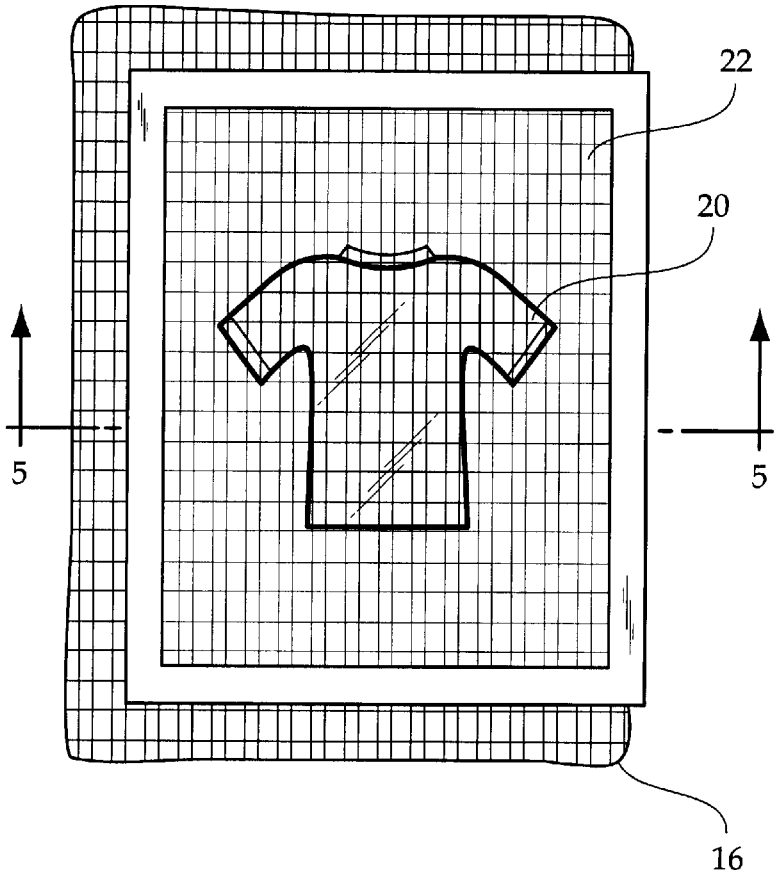
FIG. 4 is a top plan view, illustrating another embodiment of the invention, wherein a background area around the window partially obscures the selected fabric.

FIG. 4 illustrates another embodiment of the invention, wherein the background 22 is not opaque, but is less transparent than the window 20. The lesser transparency of the background 22, allows the user to focus upon the window 20, and visualize the selected fabric 16 in the context of the item defined by the window 20. Accordingly, as illustrated in FIG. 4, at the background the carrier is semi-transparent or translucent so as to somewhat obscure the selected fabric 16, but to allow the color of said selected fabric to be visible therethrough. Empirical experimentation, as well as individual user taste, may be used to determine the degree of transparency or opacity of the background 22 portion. One way in which this translucency can be achieved is by providing a rib-like texture to the carrier, as illustrated in FIG. 5.

Figure 5:
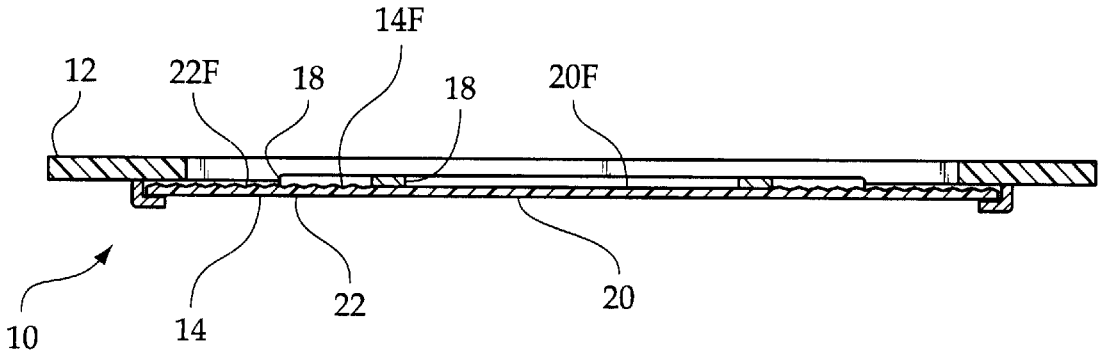
FIG. 5 is a cross sectional view, taken generally in the area of line 5—5 in FIG. 4.

FIG. 5 is a cross sectional view, illustrating the device 10, showing details of both the carrier 14 and frame 12. The thickness of the carrier 14 has been exaggerated to clearly illustrate components thereof. In particular, the object lines 18 are depicted with exaggerated height. However, the importance of illustrating the object lines 18 in this manner is to show at the sectioned portions thereof that the object lines 18 are formed out of metal.

The use of metal to form the object lines allows the object lines to be silver metallic in color. Having silver metallic colored object lines 18 is of significant importance to the invention, because it allows the selected fabric to be fully visualized, while allowing planes, features, and contours of the item to be delineated without interfering with the full visualization of the underlying selected fabric. The silver metallic colored object lines even allow darkly colored selected fabrics to be viewed without losing the detail delineated by the object lines 18.

Figure 7:
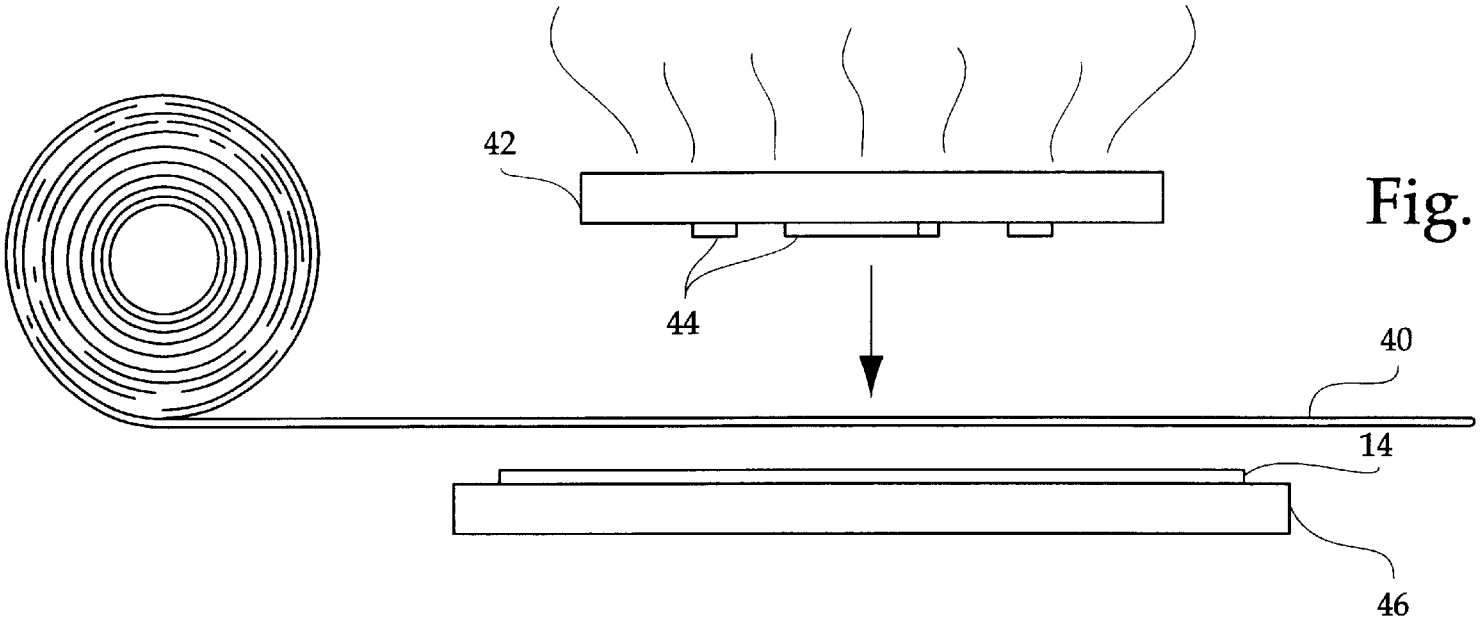
FIG. 7 is a diagrammatic side elevational view, depicting a preferred process for creating silver metallic colored object lines, using a heat transfer process to apply metallic foil to the carrier in the shape of the item.
Figure 8:
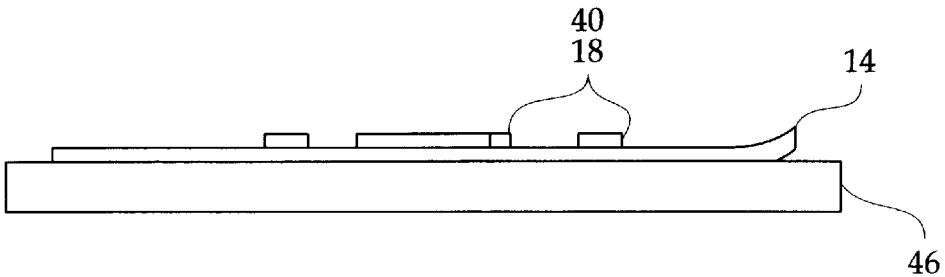
FIG. 8 is a diagrammatic side elevational view, showing the object lines present upon the carrier, formed of metal following the heat transfer process depicted in FIG. 7.

"Referring to FIG. 7, in order to create metal object lines 18, a heat transfer process is initiated, which employs silver metallic foil 40, and a die 42 having stamping members 44 formed in the shape of the desired object lines, such that the stamping members 44 resemble a pattern of the item. The carrier 14 is placed upon a temporary support surface 46. The metallic foil 40 is extended above the carrier 14, substantially parallel thereto. The die 42 is heated, typically to a temperature of approximately 225 degrees Fahrenheit, and the die 42 presses downward upon the foil 40, and thereby downward against the carrier 14. The temporary support surface 46 allows significant force to be exerted by the die 42, so that the pattern of the item is imprinted upon the carrier 14. A similar process is often used by printers desiring metallic portions of printed works. Accordingly, the specific materials employed for the metallic foil, and further details of the process employed to transfer the metallic foil onto a surface are well known to those skilled in the art, and is thus beyond the scope of the present discussion.

"FIG 7 illustrates the carrier 14 upon the temporary support surface 46 following the heat transfer. A portion of the metallic foil 40 remains on the carrier 14, and form object lines 18 which are silver metallic in color, to accomplish the purposes of the present invention. The height of the object lines 18 is exaggerated in FIG. 7 for illustrative purposes. Following the heat transfer operation, the carrier 14 is removed from the temporary support surface 46, as shown, so that it may be joined with the frame in accordance with other principles of the present invention.

Referring again to FIG. 5, the carrier 14 is shown as having an uneven ribbed front surface 22F in the background 22 area. The uneven ribbed front surface 14F is one example of how to make the background area 22 translucent, or at least less than transparent. However, the carrier has a smooth front surface 20F in the window area, where it is desirably for the carrier to be fully transparent, so that the underlying selected fabric may be viewed therethrough. Of course, different materials and configurations thereof may be employed to achieve the same goals in accordance with the inventive principles disclosed herein.

Figure 6:
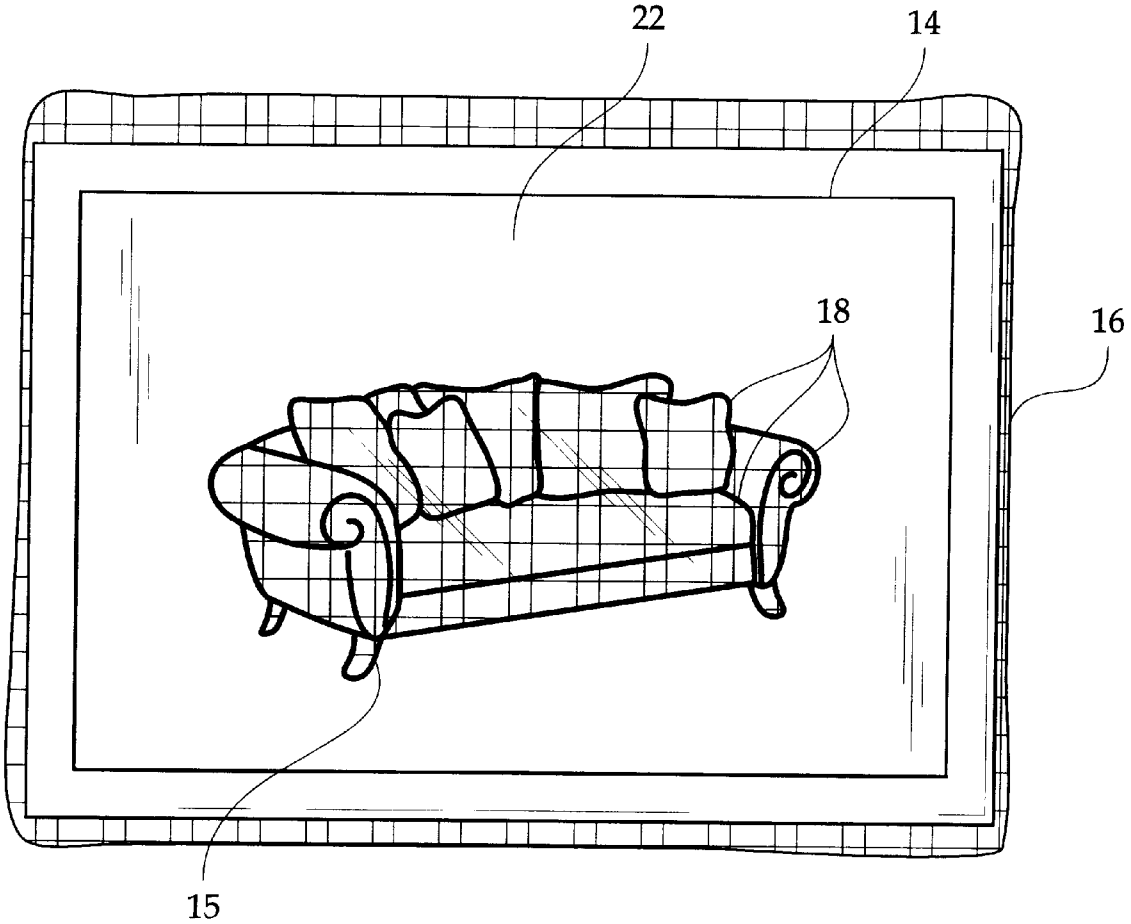
FIG. 6 is a top plan view of another embodiment of the invention, wherein the item is a home furnishing item, such as a couch, and-wherein the background area is opaque, fully obscuring the selected fabric.

FIG. 6 shows another embodiment of the invention, wherein the item is a home furnishing item, such as a couch. As illustrated, the object lines 18 are used to not only define the window 20, but also to delineate interior features such as planes, contours, and curves of the couch, and also to show accessories thereof, such as pillows and cushions. Once again, the background 22 is fully opaque, to allow the user to focus his or her attention on the selected fabric 16 in the context of the couch defined by the object lines 18. It should be apparent that in addition to the shirt and couch shown in the drawing figures, any other item made using fabric can be depicted on the carrier 14 in order to allow fabric selection to take place in accordance with the present invention.

In conclusion, herein is presented a system for allowing a user to effectively select for numerous fabric samples by visualizing an item in conjunction with that fabric sample so that the item may be visualized as if it were fabricated using the fabric sample. The invention is illustrated by example in drawing FIGS. 1 through 6. However, variations are possible while adhering to the principles of the invention. Such variations are contemplated as being a part of the inventive concept, limited only by the scope of the claims.

What is claimed is:

1. A fabric selection device, for allowing an item for which fabric is to be selected to be visualized in conjunction with a sample of a selected fabric, comprising:

a carrier, the carrier having object lines imprinted thereon for forming a graphic representation of the item, the object lines for defining an outline of the item and also defining interior features within the outline;

the carrier having a window, the window having an upper surface, the window defined by the outline object lines on the upper surface such that the window extends within the outline, the window transparent so that when the carrier is held over the selected fabric said selected fabric is clearly visible through said window, the carrier having no support structure for supporting the selected fabric sample from behind so that the carrier can be suspended directly over any selected fabric sample such that the selected fabric sample can be much larger than the carrier; and the carrier having a background defined by the object lines such that the background surrounds the outline, the background is semi-transparent so that when the carrier is held above the selected fabric said selected fabric is at least partially obscured in the background.

2. The fabric selection device as recited in claim 1, wherein the object lines are silver metallic in color.

3. The fabric selection device as recited in claim 2, wherein the object lines are made of metallic foil formed upon the carrier to create the graphic representation of the item.

4. The fabric selection device as recited in claim 2, wherein the background is opaque.

5. The fabric selection device as recited in claim 2, wherein the background is translucent.

6. The fabric selection device as recited in claim 5, wherein the carrier has a ribbed front surface in its background region so as to partially obscure view of the selected fabric.

7. The fabric selection device as recited in claim 6, further comprising a frame, the frame having an opening and a carrier retainer, the carrier supported by the frame.

8. A fabric selection method, for visualizing an item for which fabric is to be selected as if it were constructed from one of numerous selected fabric samples, using a carrier, comprising the steps of:

providing the selected fabrics;

providing a graphic representation of the item on the carrier using object lines;

providing a transparent window within the object lines, the window having an upper surface;

viewing one of the selected fabrics through the window by holding the carrier over that selected fabric sample without supporting the selected fabric from behind by the carrier or extending any portion of the carrier behind the fabric thereby allowing viewing of a fabric sample which is larger than the carrier through the window;

partially obscuring view of the selected fabric through the carrier outside of the window; and viewing another one of the selected fabrics through the window by holding the carrier over that other selected fabric sample.

9. The fabric selection method as recited in claim 8, wherein the step of providing a graphic representation of the item on the carrier using object lines further comprises delineating an outline of the item and interior features thereof using silver metallic colored object lines.

10. The fabric selection method as recited in claim 9, wherein the step of delineating the outline of the item and interior features thereof further comprises:

providing a die having stamping members, formed in a shape which depicts the object lines and interior features of the item;

heating the die;

extending silver metallic foil above the carrier, between the die and the carrier;

pressing the die downward upon the silver metallic foil, against the carrier to deposit metal foil on the carrier in the shape of the stamping members; and removing the die.

11. The fabric selection method as recited in claim 10, wherein the step of obscuring view of the selected fabric through the carrier outside of the window further comprises providing an opaque background on the carrier.

* * * * *